US007252487B2

(12) United States Patent
Sato

(10) Patent No.: US 7,252,487 B2
(45) Date of Patent: Aug. 7, 2007

(54) MULTI-STAGE ROTARY COMPRESSOR HAVING ROLLERS WHICH ARE DIFFERENT IN THICKNESS

(75) Inventor: Kazuya Sato, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 11/353,008

(22) Filed: Feb. 14, 2006

(65) Prior Publication Data

US 2006/0182646 A1 Aug. 17, 2006

(30) Foreign Application Priority Data

Feb. 17, 2005 (JP) ..... 2005-040385

(51) Int. Cl.
*F03C 2/00* (2006.01)
*F04C 23/00* (2006.01)

(52) U.S. Cl. ..... 418/60; 418/11

(58) Field of Classification Search ..... 418/11, 418/13, 58, 60, 63, 65
See application file for complete search history.

(56) References Cited

U.S. PATENT DOCUMENTS 6,616,428 B2 * 9/2003 Ebara et al. ..... 418/11
6,824,367 B2 * 11/2004 Matsumoto et al. ..... 418/60
6,892,454 B2 * 5/2005 Matsumoto et al. ..... 418/11
7,131,821 B2 * 11/2006 Matumoto et al. ..... 417/410.3

FOREIGN PATENT DOCUMENTS

EP 1316730 A2 * 6/2003
JP 60128990 A * 7/1985 ..... 418/11
JP 2001132675 A * 5/2001
JP 2004-27970 1/2004

* cited by examiner

*Primary Examiner*—Theresa Trieu
(74) *Attorney, Agent, or Firm*—Armstrong, Kratz, Quintos, Hanson & Brooks, LLP

(57) ABSTRACT

In a high inner pressure type multistage compression system rotary compressor whose object is to improve sealability of a first rotary compression element and which includes a second rotary compression element having a displacement volume being smaller than that of the first rotary compression element and in which a refrigerant compressed by the first rotary compression element is compressed by the second rotary compression element to discharge the refrigerant into a sealed container, heights of a first cylinder of the first rotary compression element and a second cylinder of the second rotary compression element are set to be equal, diameters of both of eccentric portions are set to be equal, an inner diameter of the first cylinder is set to be larger than that of the second cylinder, and a thickness of a first roller is set to be larger than that of a second roller.

2 Claims, 6 Drawing Sheets

MULTI-STAGE ROTARY COMPRESSOR HAVING ROLLERS WHICH ARE DIFFERENT IN THICKNESS

BACKGROUND OF THE INVENTION

1. Field of the Invention

The present invention relates to a rotary compressor which is provided with a driving element and first and second rotary compression elements driven by a rotation shaft of this driving element, the elements being disposed in a sealed container, and in which a refrigerant compressed by the first rotary compression element is compressed by the second rotary compression element to send the refrigerant into the sealed container.

2. Description of the Related Art

Heretofore, in this type of rotary compressor, for example, a high inner pressure type rotary compressor, a rotation shaft is of a vertically disposed type. The compressor includes: a driving element; a first rotary compression element driven by the rotation shaft of this driving element; and a second rotary compression element whose displacement volume is smaller than that of the first rotary compression element, the elements being disposed in a sealed container. The first and second rotary compression elements are constituted of: upper and lower cylinders constituting the first and second rotary compression elements, respectively; rollers fitted into eccentric portions disposed on the rotation shaft to eccentrically rotate in the respective cylinders; an intermediate partition plate disposed between the respective cylinders to close an opening of one of the opposite cylinders; and a support member which closes the other opening of each cylinder and which includes a bearing of the rotation shaft. The face of each support member on a side opposite to each cylinder is depressed, and this depressed portion is closed with a cover to thereby form a discharge noise absorbing chamber.

Moreover, when the driving element is driven, the rollers fitted into the eccentric portions disposed integrally with the rotation shaft eccentrically rotate in the upper and lower cylinders. Accordingly, a refrigerant gas is sucked from a suction port of the first rotary compression element into the cylinder on a low-pressure chamber side. The gas is compressed by operations of the roller and a vane to obtain an intermediate pressure. The gas is discharged from the cylinder on a high-pressure chamber side to the discharge noise absorbing chamber via a discharge port. Thereafter, the intermediate-pressure refrigerant gas discharged to the discharge noise absorbing chamber is sucked from the suction port of the second rotary compression element into the cylinder on the low-pressure chamber side. Then, the gas is compressed by the operation of the roller and vane in a second stage to form a high-temperature high-pressure refrigerant gas, and the gas is discharged from the high-pressure chamber side into the sealed container via the discharge port and the discharge noise absorbing chamber. Accordingly, the inside of the sealed container has high temperature and pressure. On the other hand, the refrigerant gas sent into the sealed container is discharged from a refrigerant discharge tube to the outside of the rotary compressor (see, e.g., Japanese Patent Application Laid-Open No. 2004-27970).

In such multistage compression type rotary compressor, a thickness (dimension in a roller diametric direction) of each roller is set so that a displacement volume of the first rotary compression element as a first stage is larger than that of the second rotary compression element as a second stage. That is, heretofore, the upper and lower cylinders having equal inner diameters (bore diameter) and heights, and the opposite eccentric portions having equal diameters are used with respect to the first and second rotary compression elements. The thickness of the first roller is set to be smaller than that of the second roller so that the displacement volume of the first rotary compression element becomes larger than that of the second rotary compression element.

However, the high inner pressure type rotary compressor has a large pressure difference between the cylinder of the first rotary compression element and the sealed container. In a case where the thickness of the roller of the first rotary compression element is reduced to reduce a sealing width by the roller, a problem occurs that the refrigerant leaks from a roller end face.

Especially, a gap between the intermediate partition plate and the rotation shaft has a high pressure in the same manner as in the inside of the sealed container. Therefore, this high pressure easily flows from the roller end face into the cylinder. When the thickness of the roller of the first rotary compression element is reduced, the inflow of such high pressure increases, and a volume efficiency of the first rotary compression element disadvantageously deteriorates.

SUMMARY OF THE INVENTION

The present invention has been developed to solve such problems of the conventional technology, and an object is to improve sealability of a roller of a first rotary compression element in a high inner pressure type multistage compression system rotary compressor.

A rotary compressor of a first aspect of the present invention is provided with a sealed container: containing a driving element; and first and second rotary compression elements driven by a rotation shaft of this driving element, the displacement volume of the second rotary compression element is smaller than that of the first rotary compression element, and a refrigerant compressed by the first rotary compression element being compressed by the second rotary compression element to discharge the refrigerant into the sealed container, the rotary compressor comprising: first and second cylinders constituting the first and second rotary compression elements, respectively; first and second rollers fitted into first and second eccentric portions formed on the rotation shaft to eccentrically rotate in the first and second cylinders, respectively; and an intermediate partition plate which is disposed between the respective cylinders to close an opening of one of the opposite cylinders, a thickness of the first roller being set to be larger than that of the second roller.

In the rotary compressor of a second aspect of the present invention, in the first aspect of the present invention, heights of the opposite cylinders are set to be equal, diameters of the opposite eccentric portions are set to be equal, an inner diameter of the first cylinder is set to be larger than that of the second cylinder, and the thickness of the first roller is set to be larger than that of the second roller.

In the rotary compressor of a third aspect of the present invention, in the first aspect of the present invention, the first rotary compression element is disposed on a driving element side of the intermediate partition plate, the inner diameters of the opposite cylinders are set to be equal, the diameter of the first eccentric portion is set to be smaller than that of the second eccentric portion, and the thickness of the first roller is set to be larger than that of the second roller.

According to the rotary compressor of the first aspect of the present invention, the thickness of the first roller is set to be larger than that of the second roller. Therefore, for example, as in the second aspect of the present invention, the heights of the opposite cylinders are set to be equal, the diameters of the opposite eccentric portions are set to be equal, and the inner diameter of the first cylinder is set to be larger than that of the second cylinder. Accordingly, it is possible to increase the thickness of the first roller.

Moreover, even in a case where the inner diameters of the opposite cylinders are set to be equal, and the diameter of the first eccentric portion is set to be smaller than that of the second eccentric portion as in the third aspect of the present invention, since the diameter of the first eccentric portion is reduced, it is possible to increase the thickness of the first roller.

In consequence, the thickness of the first roller can be set to be larger than that of the second roller, and refrigerant leaks from an end face of the first roller can be reduced to improve sealability of the first roller.

DETAILED DESCRIPTION OF THE PREFERRED EMBODIMENT

There will be described hereinafter embodiments of a rotary compressor of the present invention in detail with reference to the drawings.

Embodiment 1

Figure 1:
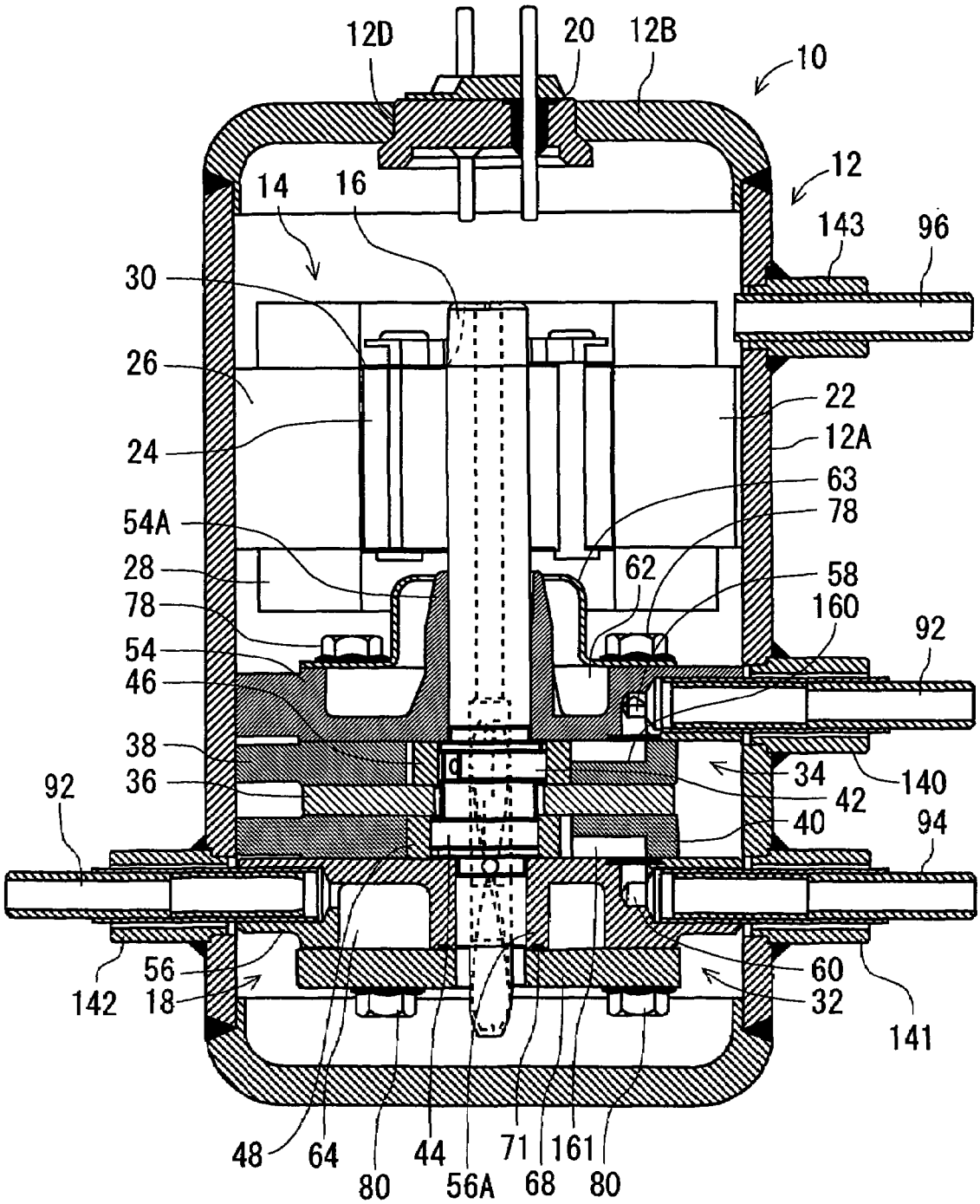
FIG. 1 is a vertical side view of a high inner pressure type rotary compressor in one embodiment of the present invention.
Figure 2:
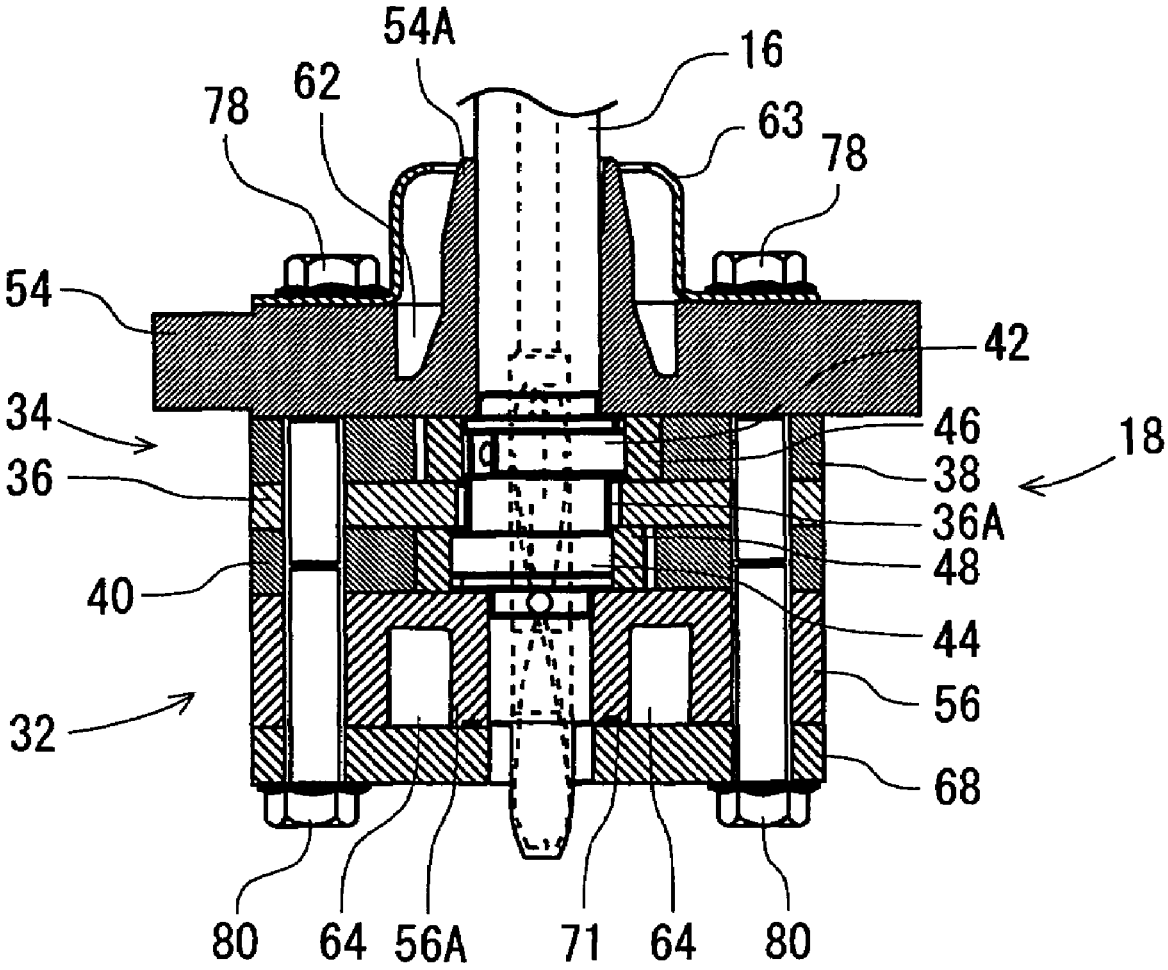
FIG. 2 is a vertical side view showing first and second rotary compression elements of the rotary compressor of FIG. 1.
Figure 3:
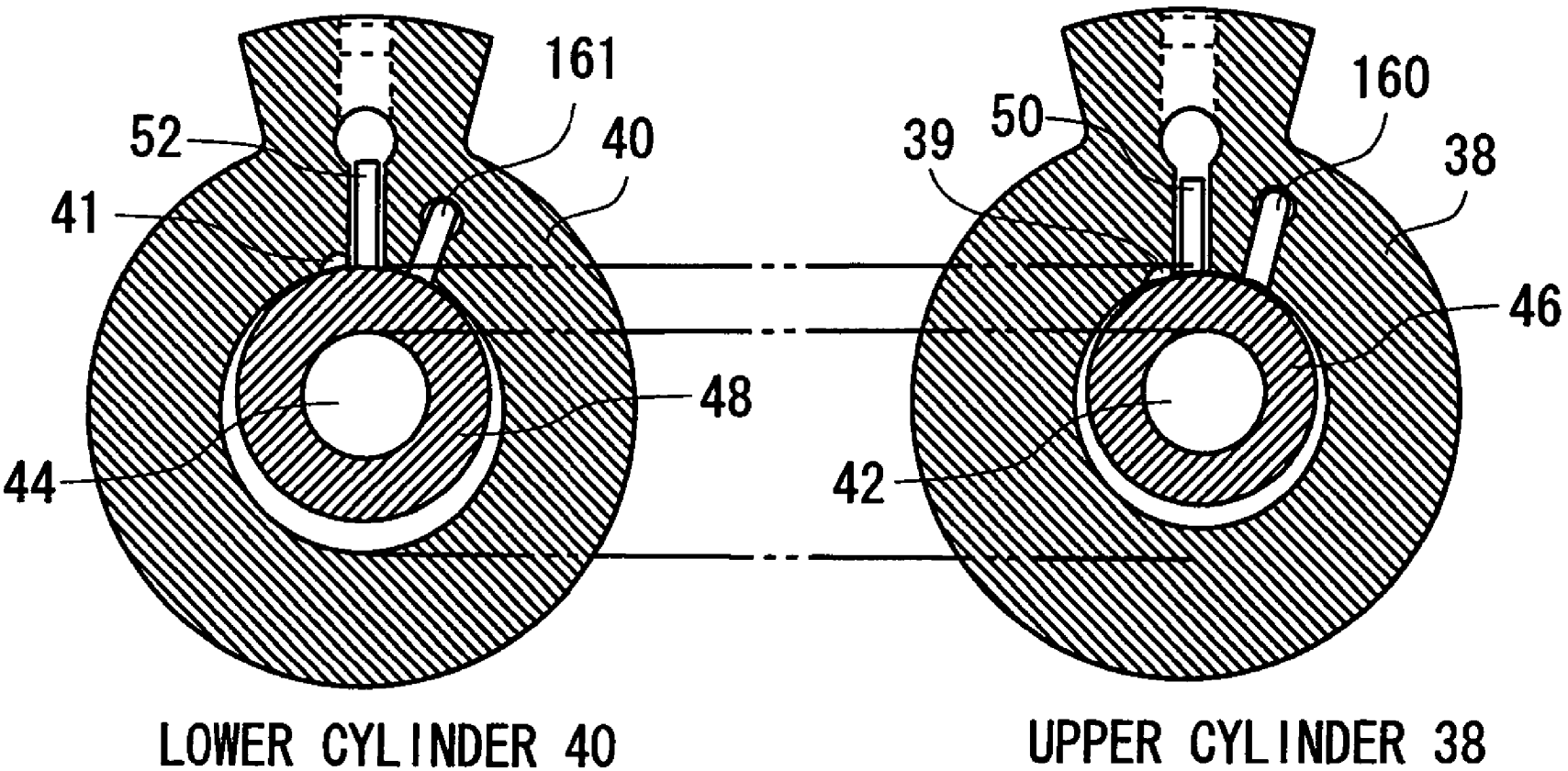
FIG. 3 is a sectional plan view of cylinders of the first and second rotary compression elements of the rotary compressor shown in FIG. 1.

FIG. 1 is a vertical sectional side view showing a so-called high inner pressure type multistage compression system rotary compressor 10 as one embodiment of the rotary compressor of the present invention. In the compressor, a refrigerant compressed by a first rotary compression element 32 is compressed by a second rotary compression element 34, and sent into a sealed container 12. FIG. 2 shows a vertical sectional side view of the first and second rotary compression elements 32, 34 of the rotary compressor 10, and FIG. 3 shows a sectional plan view of upper and lower cylinders 38, 40 of the first and second rotary compression elements 32, 34, respectively. It is to be noted that FIGS. 1 and 2 show different sections, respectively.

In the rotary compressor 10 of each drawing, in the vertical cylindrical sealed container 12 constituted of a steel plate, there are disposed an electromotive element 14 as a driving element, and a rotary compression mechanism section 18 constituted of the first rotary compression element 32 driven by a rotation shaft 16 of this electromotive element 14 and the second rotary compression element 34 whose displacement volume is smaller than that of the first rotary compression element 32. It is to be noted that carbon dioxide ($CO_2$) is used as the refrigerant in the rotary compressor 10 of the present embodiment.

The sealed container 12 is constituted of: a container main body 12A whose bottom is an oil reservoir and which contains the electromotive element 14 and the rotary compression mechanism section 18; and an end cap (lid member) 12B which closes an upper opening of this container main body 12A and which substantially has a bowl shape. Moreover, a circular attaching hole 12D is formed in the top of this end cap 12B, and the attaching hole 12D is provided with a terminal (wiring line is omitted) 20 for supplying power to the electromotive element 14.

The electromotive element 14 is constituted of a stator 22 annularly welded and fixed along an inner peripheral surface of the sealed container 12 in the upper space, and a rotor 24 inserted and disposed with a slight interval from an inner wall of this stator 22. This rotor 24 is fixed to the rotation shaft 16 passing through the center in a vertical direction.

The stator 22 has a laminate 26 formed by laminating donut-shaped electromagnetic steel plates and a stator coil 28 wound around a tooth portion of this laminate 26 by a direct winding (concentrated winding) system. The rotor 24 is constituted of a laminate 30 of electromagnetic steel plates in the same manner as in the stator 22.

In the rotary compression mechanism section 18, the second rotary compression element 34 constituting a second stage via an intermediate partition plate 36 is disposed on the side of the electromotive element 14 in the sealed container 12, and the first rotary compression element 32 constituting a first stage is disposed on a side opposite to the electromotive element 14. That is, the first rotary compression element 32 is constituted of: the lower cylinder 40 as a first cylinder constituting the first rotary compression element 32; a first roller 48 fitted into a first eccentric portion 44 formed on the rotation shaft 16 to eccentrically rotate in the lower cylinder 40; and a lower support member 56 which closes a lower (the other) opening of the lower cylinder 40 and which has a bearing 56A of the rotation shaft 16. The second rotary compression element 34 is constituted of: the upper cylinder 38 as a second cylinder constituting the second rotary compression element 34; a second roller 46 fitted into a second eccentric portion 42 formed on the rotation shaft 16 with a phase difference of 180 degrees from the first eccentric portion 44 to eccentrically rotate in the upper cylinder 38; and an upper support member 54 which closes an upper (the other) opening of the upper cylinder 38 and which has a bearing 54A of the rotation shaft 16.

Moreover, the intermediate partition plate 36 is disposed between the upper cylinder 38 and the lower cylinder 40 to close one opening (a lower opening of the upper cylinder 38 and an upper opening of the lower cylinder 40) of each of the opposite cylinders 38, 40.

The lower cylinder 40 is provided with a suction port 161 which connects a suction passage 60 formed in the lower support member 56 to a low-pressure chamber in the lower cylinder 40. Similarly, the upper cylinder 38 is provided with a suction port 160 which connects a suction passage 58 formed in the upper support member 54 to the low-pressure chamber in the lower cylinder 40.

Moreover, the (lower) surface of the lower support member 56 on the side opposite to the lower cylinder 40, that is, the outside of the bearing 56A is depressed, and this depressed portion is closed with a lower cover 68, thereby forming a discharge noise absorbing chamber 64. Similarly, the (upper) surface of the upper support member 54 on a side opposite to the upper cylinder 38 is depressed, and this depressed portion is closed with an upper cover 63, thereby forming a discharge noise absorbing chamber 62.

In this case, the bearing 54A is raised in the center of the upper support member 54. The bearing 56A is formed through the center of the lower support member 56. The surface (lower face) of the bearing 56A which abuts on the lower cover 68 is provided with an O-ring groove (not shown), and an O-ring 71 is included in the O-ring groove.

On the other hand, the first and second rotary compression elements 32, 34 are fastened from a lower cover 68 side with a plurality of main bolts 80 . . . . That is, in the present embodiment, the lower cover 68, the lower support member 56, the lower cylinder 40, the intermediate partition plate 36, and the upper cylinder 38 are fastened with four main bolts 80 . . . from the lower cover 68 side. The upper cylinder 38 is provided with thread grooves which engage with thread ridges formed on tip portions of the main bolts 80 . . .

Here, there will be described a procedure for assembling the rotary compression mechanism section 18 constituted of the first and second rotary compression elements 32, 34. First, the upper cover 63, the upper support member 54, and the upper cylinder 38 are positioned, and two upper bolts 78, 78 to engage with the upper cylinder 38 are inserted from an upper cover 63 side (upper side) in an axial center direction (downward direction) to integrate the upper cover, the upper support member, and the upper cylinder. Accordingly, the second rotary compression element 34 is assembled.

Next, the second rotary compression element 34 integrated with the above-described upper bolts 78, 78 is passed along the rotation shaft 16. Moreover, the intermediate partition plate 36 and the lower cylinder 40 are assembled, inserted along the rotation shaft 16 from a lower end, and positioned with the already attached upper cylinder 38. Two upper bolts (not shown) to engage with the lower cylinder 40 are inserted from an upper cover 63 side (upper side) in the axial center direction (downward direction), and the intermediate partition plate and the lower cylinder are fixed.

Moreover, after inserting the lower support member 56 from the lower end along the rotation shaft 16, similarly, the lower cover 68 is inserted from the lower end along the rotation shaft 16 to close the depressed portion formed in the lower support member 56, and four main bolts 80 . . . are inserted from the lower cover 68 side (lower side) in the axial center direction (upward direction). At this time, the thread ridges formed on the tip portions of the main bolts 80 . . . are engaged with the thread grooves formed in the upper cylinder 38 to fasten them, and the first and second rotary compression elements 32, 34 are assembled.

On the other hand, the rotary compressor 10 of the present invention is constituted so that a thickness (thickness of the first roller 48 in a diametric diameter) of the first roller 48 of the first rotary compression element 32 is larger that that of the second roller 46 of the second rotary compression element 34.

In the present embodiment, heights (dimensions in the axial center direction) of the upper and lower cylinders 38, 40 constituting the first and second rotary compression elements 32, 34, respectively, are set to be equal, and diameters of the opposite eccentric portions 42, 44 are set to be equal. An inner diameter (bore diameter of the lower cylinder 40) of the lower cylinder 40 is set to be larger than that of an inner diameter (bore diameter of the upper cylinder 38) of the upper cylinder 38. Accordingly, a thickness of the first roller 48 is set to be larger than that of the second roller 46.

Figure 6:
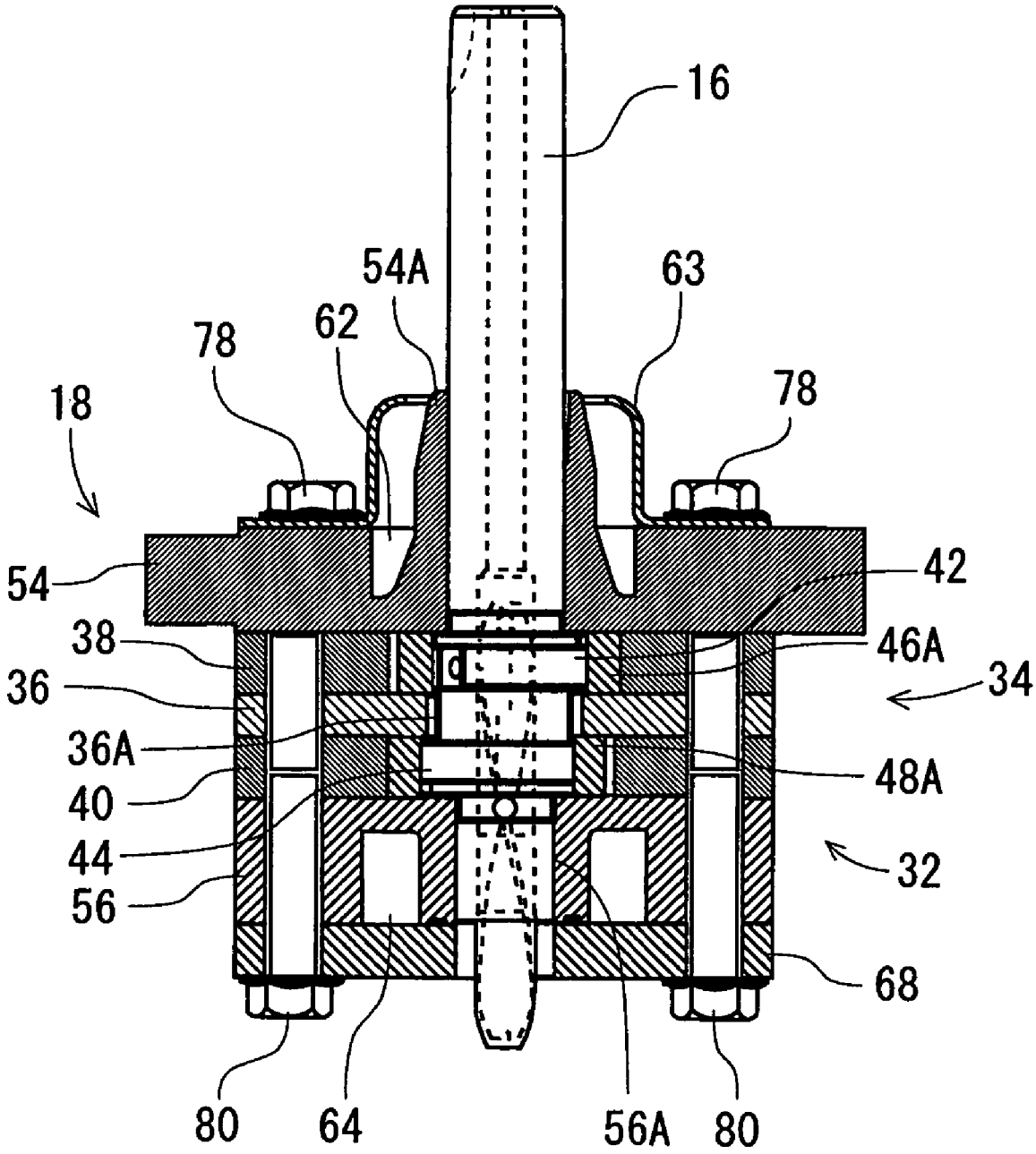
FIG. 6 is a vertical side view showing first and second rotary compression elements of a conventional high inner pressure type rotary compressor.

In a conventional constitution, as shown in FIG. 6, inner diameters (bore diameters) of upper and lower cylinders 38, 40 are set to be equal, diameters of eccentric portions 42, 44 are set to be equal, and thicknesses of a first roller 48A and a second roller 46A are set so that a displacement volume of a first rotary compression element 32 becomes larger than that of the second rotary compression element 34.

That is, a thickness of the first roller 48A is set to be smaller than that of the second roller 46A, and the displacement volume of the first rotary compression element 32 is set to be larger than that of a second rotary compression element 34.

However, when the thickness of the first roller 48A is reduced, sealing widths of upper and lower end faces of the first roller 48A decrease. In this case, in the high inner pressure type rotary compressor 10, a pressure difference between the lower cylinder 40 of the first rotary compression element 32 and the sealed container 12 is large. Therefore, a problem occurs that the decrease of the sealing width of the first roller 48A results in increases of refrigerant leaks from the upper and lower end faces of the first roller 48A.

Especially, a high pressure is obtained in a gap 36A between an intermediate partition plate 36 to close the upper opening of the lower cylinder 40 and the rotation shaft 16 disposed in the plate in the same manner as in the inside of the sealed container 12. Thereafter, heretofore the high pressure stored in the gap 36A easily flows from the upper end face of the first roller 48A into the lower cylinder 40. Therefore, in a case where the thickness of the first roller 48A is reduced as in the conventional technology, a disadvantage occurs that the leak from the end face of the first roller 48A further increases.

Furthermore, in a case where carbon dioxide having a large difference between high and low pressures is used as a refrigerant as in the present embodiment, such pressure difference between the high pressure and the pressure in the lower cylinder 40 is large. Therefore, when the thickness of the first roller 48A is reduced, sealability by the first roller 48A further deteriorates. This causes deterioration of volume efficiency of the first rotary compression element 32.

However, when the inner diameter of the lower cylinder 40 is set to be larger than that of the upper cylinder 38, the thickness of the first roller 48 can be set to be larger than that of the second roller 46 while setting the displacement volume of the first rotary compression element 32 to be larger than that of the second rotary compression element 34.

Moreover, when the inner diameter of the lower cylinder 40 is set to be larger than that of the upper cylinder 38, the thickness of the first roller 48 can be set to be larger than that of the second roller 46, whereas the heights of the upper and lower cylinders 38, 40 and the diameters of the opposite eccentric portions 42, 44 remain to be equal.

Since the diameters of the eccentric portions 42, 44 remain to be conventional in this manner, working of the rotation shaft 16 does not have to be changed. The heretofore used upper cylinder 38 and second roller 46 are usable as such. Furthermore, since the height of the lower cylinder 40 also remains to be conventional, a heretofore used material of the lower cylinder 40 is usable as such, and an only inner diameter during machining may be changed. Therefore, in the present embodiment, at least the material of the lower cylinder 40 is used as such, and the machining and the changing of the outer diameter of the first roller 48 may only be performed. In consequence, while the changes of the components are minimized, the thickness of the first roller 48 can be set to be larger than that of the second roller 46.

Therefore, the refrigerant leak from the end face of the first roller 48 can be reduced, and the sealability of the first roller 48 can be improved.

On the other hand, the upper cover 63 is provided with a communication path (not shown) which connects the discharge noise absorbing chamber 62 to the inside of the sealed container 12, and a high-temperature high-pressure refrigerant gas compressed by the second rotary compression element 34 is discharged from this communication path into the sealed container 12.

Moreover, sleeves 140, 141, 142, and 143 are welded and fixed to the side of the container main body 12A of the sealed container 12 in positions corresponding to the suction passages 58, 60 of the upper and lower support members 54, 56 and upper parts of the discharge noise absorbing chamber 64 and the electromotive element 14, respectively. The sleeve 140 is vertically adjacent to the sleeve 141, and the sleeve 142 is disposed substantially diagonally with respect to the sleeve 140.

One end of a refrigerant introducing tube 92 for introducing the refrigerant gas into the upper cylinder 38 is inserted and connected into the sleeve 140, and one end of this refrigerant introducing tube 92 is connected to the suction passage 58 of the upper cylinder 38. This refrigerant introducing tube 92 passes through the upper part of the sealed container 12 and reaches the sleeve 142. The other end of the refrigerant introducing tube is inserted and connected into the sleeve 142 to communicate with the discharge noise absorbing chamber 64.

Moreover, one end of a refrigerant introducing tube 94 for introducing the refrigerant gas into the lower cylinder 40 is inserted and connected into the sleeve 141, and one end of this refrigerant introducing tube 94 is connected to the suction passage 60 of the lower cylinder 40. A refrigerant discharge tube 96 is inserted and connected into the sleeve 143, and one end of the refrigerant discharge tube 96 is connected into the sealed container 12.

Next, there will be described an operation of the rotary compressor 10 constituted as described above. When the stator coil 28 of the electromotive element 14 is energized via the terminal 20 and the wiring line (not shown), the electromotive element 14 is started to rotate the rotor 24. This rotation results in eccentric rotation of the rollers 46, 48 fitted into the eccentric portions 42, 44 disposed integrally with the rotation shaft 16 in the upper and lower cylinders 38, 40.

Accordingly, a low-pressure refrigerant gas is sucked from the suction port 161 into the lower cylinder 40 on the low-pressure chamber side via the refrigerant introducing tube 94 and the suction passage 60 formed in the lower support member 56, and the gas is compressed by the operations of the roller 48 and a vane 52 to obtain an intermediate pressure. The compressed intermediate-pressure refrigerant gas is discharged from the lower cylinder 40 on the high-pressure chamber side into the discharge noise absorbing chamber 64 via a discharge port 41.

The intermediate-pressure refrigerant gas discharged into the discharge noise absorbing chamber 64 passes through the refrigerant introducing tube 92 which communicates with the discharge noise absorbing chamber 64, and the gas is sucked from the suction port 160 to the upper cylinder 38 on the low-pressure chamber side via the suction passage 58 formed in the upper support member 54.

On the other hand, the intermediate-pressure refrigerant gas sucked into the upper cylinder 38 is compressed in the second stage by the operations of the roller 46 and a vane 50 to form a high-temperature high-pressure refrigerant gas. The gas is discharged from the lower cylinder 40 on the high-pressure chamber side into the discharge noise absorbing chamber 64 via a discharge port 39.

Moreover, the refrigerant discharged to the discharge noise absorbing chamber 62 is delivered into the sealed container 12 via the communication path (not shown). Thereafter, the refrigerant passes through the gap of the electromotive element 14 to move into the upper part of the sealed container 12, and is discharged to the outside of the rotary compressor 10 from the refrigerant discharge tube 96 connected to the upper part of the sealed container 12.

As described above in detail, as in the present embodiment, the heights of the upper and lower cylinders 38, 40 constituting the first and second rotary compression elements 32, 34, respectively, are set to be equal. The diameters of the opposite eccentric portions 42, 44 are set to be equal. Moreover, the inner diameter (bore diameter of the lower cylinder 40) of the lower cylinder 40 is set to be larger than that of the inner diameter (bore diameter of the upper cylinder 38) of the upper cylinder 38. Accordingly, sudden rise of a production cost due to a design change is suppressed. Moreover, the thickness of the first roller 48 is set to be larger than that of the second roller 46, so that the displacement volume of the first rotary compression element 32 can be set to be larger than that of the second rotary compression element 34. In consequence, the sealability of the first roller 48 is improved, and the volume efficiency of the first rotary compression element 32 can be improved.

Embodiment 2

Figure 4:
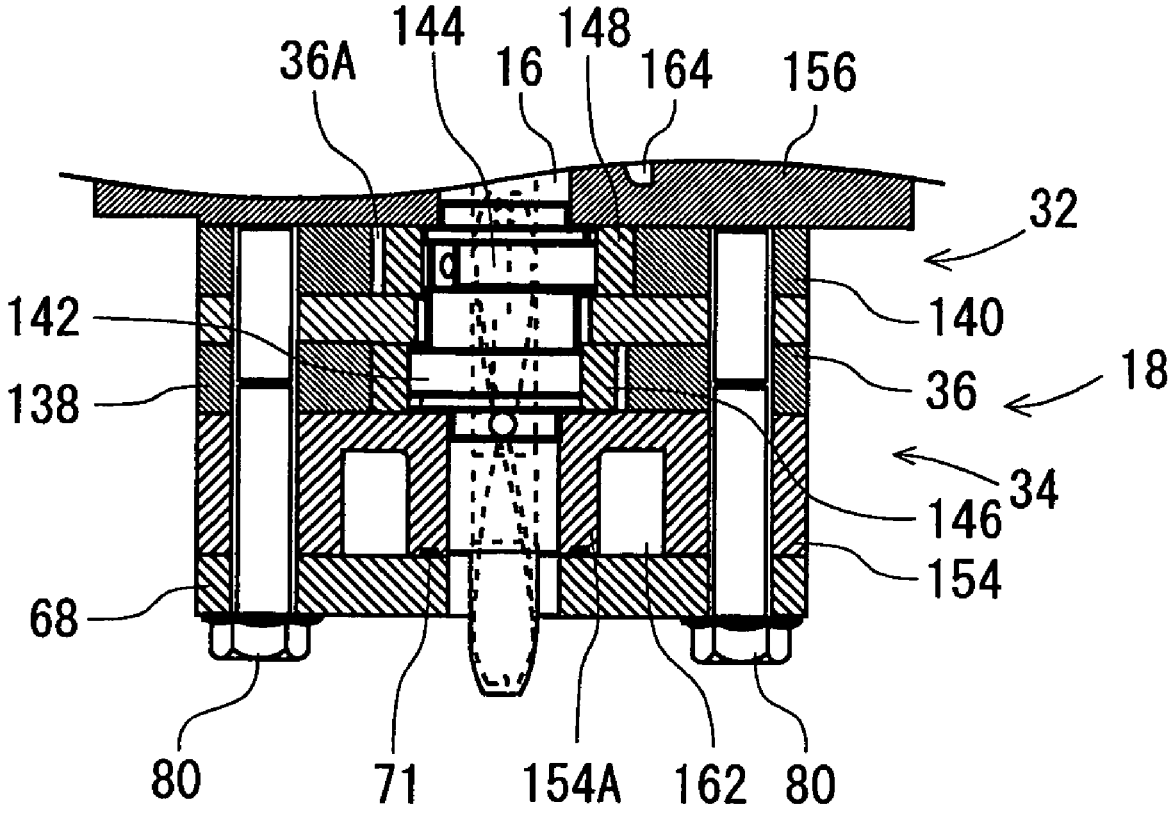
FIG. 4 is a vertical side view showing first and second rotary compression elements of a rotary compressor in another embodiment of the present invention.
Figure 5:
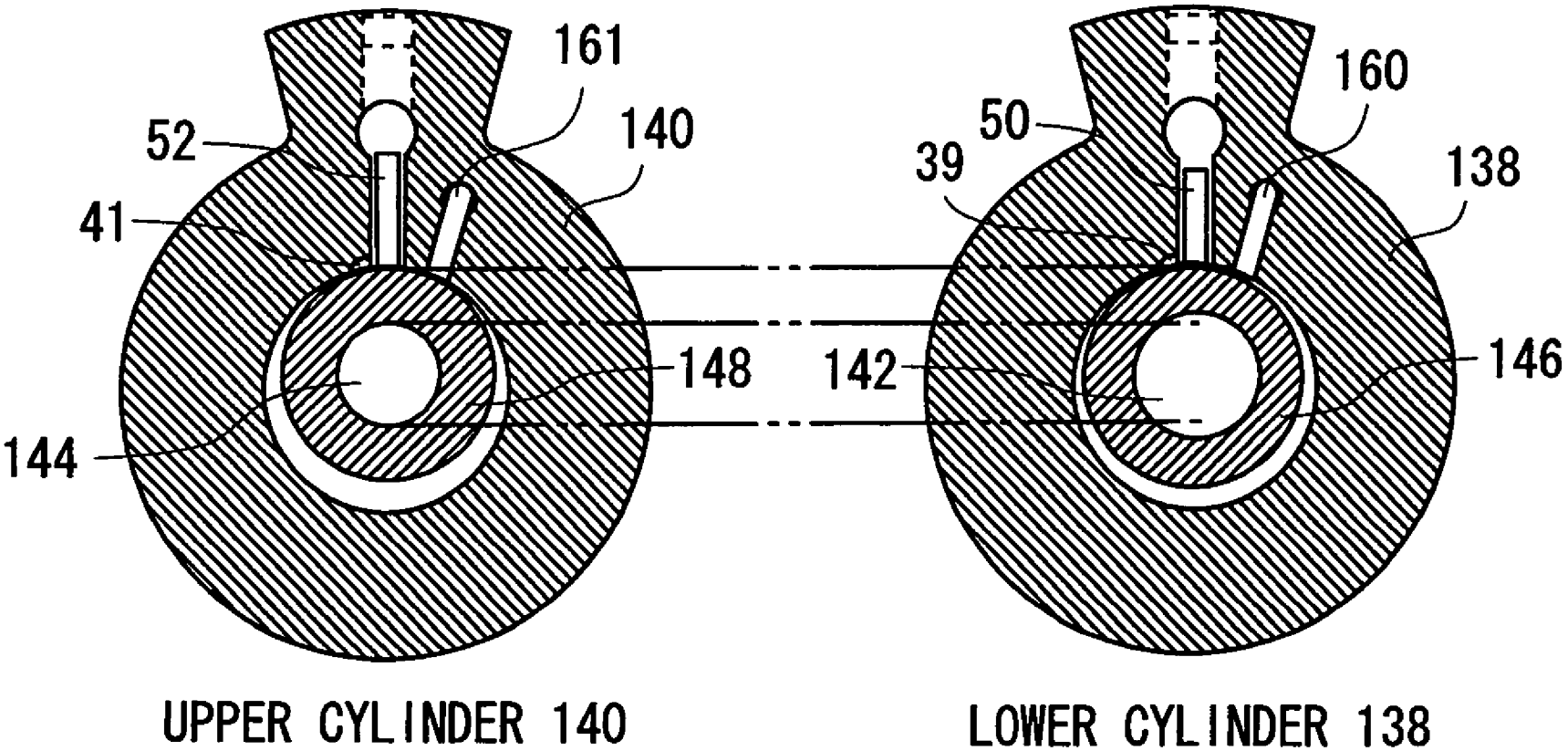
FIG. 5 is a sectional plan view of cylinders of the first and second rotary compression elements of the rotary compressor shown in FIG. 4.

Next, another embodiment of a rotary compressor of the present invention will be described with reference to FIGS. 4 and 5. FIG. 4 shows a vertical sectional side view showing first and second rotary compression elements 32, 34 of the rotary compressor in the present embodiment, and FIG. 5 shows a sectional plan view of cylinders 138, 140, respectively. It is to be noted that in FIGS. 4 and 5, components denoted with the same reference numerals as those of FIGS. 1 to 3 produce identical or similar effects.

In the rotary compressor of the present embodiment, in a vertical cylindrical sealed container constituted of a steel plate, there are disposed an electromotive element as a driving element, and a rotary compression mechanism section 18 constituted of the first rotary compression element 32 driven by a rotation shaft 16 of this electromotive element 14 and the second rotary compression element 34 whose displacement volume is smaller than that of the first rotary compression element 32 in the same manner as in the above embodiment.

In the rotary compression mechanism section 18, the first rotary compression element 32 constituting a first stage via the intermediate partition plate 36 is disposed on an electromotive element 14 side (above the intermediate partition plate 36 in FIG. 4), and the second rotary compression element 34 constituting a second stage is disposed on a side (below the intermediate partition plate 36 in FIG. 4) opposite to the electromotive element 14.

The first rotary compression element 32 is constituted of: the upper cylinder 140 as a first cylinder constituting the first rotary compression element 32; a first roller 148 fitted into a first eccentric portion 144 formed on the rotation shaft 16 to eccentrically rotate in the upper cylinder 140; and an upper support member 156 which closes an upper (the other) opening of the upper cylinder 140 and which has a bearing of the rotation shaft 16. The second rotary compression element 34 is constituted of: the lower cylinder 138 as a second cylinder constituting the second rotary compression element 34; a second roller 146 fitted into a second eccentric portion 142 formed on the rotation shaft 16 with a phase difference of 180 degrees from the first eccentric portion 144 to eccentrically rotate in the lower cylinder 138; and a lower support member 154 which closes a lower (the other) opening of the lower cylinder 138 and which has a bearing 154A of the rotation shaft 16.

Moreover, the intermediate partition plate 36 is disposed between the upper cylinder 140 and the lower cylinder 138 to close one opening (a lower opening of the upper cylinder 140 and an upper opening of the lower cylinder 138) of each of the opposite cylinders 138, 140. The intermediate partition plate 36 is constituted of a substantially donut-shaped steel plate having a hole for inserting the rotation shaft through the center. A diameter of this hole is slightly larger than that of the first eccentric portion 144, and is, for example, the diameter of the first eccentric portion 144+ about 0.1 mm.

The upper cylinder 140 is provided with a suction port 161 which connects a suction passage (not shown) formed in the upper support member 156 to a low-pressure chamber in the upper cylinder 140. Similarly, the lower cylinder 138 is provided with a suction port 160 which connects a suction passage (not shown) formed in the lower support member 154 to the low-pressure chamber in the lower cylinder 138.

Moreover, the (upper) surface of the upper cylinder 140 on the side opposite to the upper cylinder 40 is depressed, and this depressed portion is closed with an upper cover (not shown), thereby forming a discharge noise absorbing chamber 164. Similarly, the (lower) surface of the lower support member 154 on a side opposite to the lower cylinder 138, that is, the outside of the bearing 154A is depressed, and this depressed portion is closed with a lower cover 68, thereby forming a discharge noise absorbing chamber 162.

In this case, the surface (lower face) of the bearing 154A which abuts on the lower cover 68 is provided with an O-ring groove (not shown), and an O-ring 71 is included in the O-ring groove.

On the other hand, the rotary compressor of the present invention is constituted so that a thickness of the first roller 148 of the first rotary compression element 32 is larger that that of the second roller 146 of the second rotary compression element 34.

In the present embodiment, inner diameters of the upper and lower cylinders 140 and 138 constituting the first and second rotary compression elements 32, 34, respectively, are set to be equal. A diameter of the first eccentric portion 144 is set to be smaller than that of the second eccentric portion 142, and a thickness of the first roller 148 is set to be larger than that of the second roller 146. It is to be noted that heights (dimensions in an axial center direction) of the opposite cylinders 138, 140 are set to be equal.

As described above, when the diameter of the first eccentric portion 144 is set to be smaller than that of the second eccentric portion 142, the thickness of the first roller 148 can be set to be larger than that of the second roller 146 while setting the displacement volume of the first rotary compression element 32 to be larger than that of the second rotary compression element 34.

Accordingly, the displacement volume of the first rotary compression element 32 can be set to be larger than that of the second rotary compression element 34 without setting the thickness of the first roller 148 to be smaller than that of the second roller 146. Therefore, it is possible to eliminate increases of refrigerant leaks from the upper and lower end faces of the first roller 148 due to decreases of sealing widths of the upper and lower end faces of the first roller 148 as in the conventional technology.

Especially, a high pressure is obtained in a gap 36A between the intermediate partition plate 36 to close the lower opening of the upper cylinder 140 and the rotation shaft 16 disposed in the plate in the same manner as in the inside of the sealed container 12. However, heretofore the high pressure stored in the gap 36A easily flows from the lower end face of the first roller 148 into the upper cylinder 140. Therefore, when the thickness of the first roller 148 is reduced to set the above-described displacement volume, a problem occurs that the sealing width by the first roller 148 decreases, and the high-pressure leak further increases.

Furthermore, in a case where carbon dioxide having a large difference between high and low pressures is used as a refrigerant as in the present embodiment, such pressure difference between the high pressure and the pressure in the upper cylinder 140 is large. Therefore, when the thickness of the first roller 148 is reduced, sealability by the first roller 148 further deteriorates. This causes deterioration of volume efficiency of the first rotary compression element 32.

However, when the diameter of the first eccentric portion 144 is set to be smaller than that of the second eccentric portion 142 as in the present embodiment, the thickness of the first roller 148 can be set to be larger than that of the second roller 146 while setting the displacement volume of the first rotary compression element 32 to be larger than that of the second rotary compression element 34. The sealability by the first roller 148 can be improved.

Moreover, when the diameter of the first eccentric portion 144 is set to be smaller than that of the second eccentric portion 142, the thickness of the first roller 148 can be set to be larger than that of the second roller 146, whereas the heights of the upper and lower cylinders 140, 138 and the inner diameters of the opposite cylinders 138, 140 remain to be equal.

Since the inner diameters of the upper and lower cylinders 138, 140 are set to be equal, and the heights thereof are set to be equal as in the conventional technology, the heretofore used upper and lower cylinders 138, 140 are usable as such. Furthermore, since the diameter of the second eccentric portion 142 also remains to be conventional, machining may only be performed so as to set the diameter of the first eccentric portion 144 formed on the rotation shaft 16 to be smaller than the conventional diameter. The inner diameter of the first roller 148 or the inner and outer diameters may only be changed. Consequently, while the changes of the components are minimized, the thickness of the first roller 148 can be set to be larger than that of the second roller 146.

On the other hand, the first and second rotary compression elements 32, 34 are fastened from a lower cover 68 side with a plurality of main bolts 80 . . . That is, in the present embodiment, the lower cover 68, the lower support member 154, the lower cylinder 138, the intermediate partition plate 36, and the upper cylinder 140 are fastened with four main bolts 80 . . . from the lower cover 68 side. The upper cylinder 140 is provided with thread grooves which engage with thread ridges formed on tip portions of the main bolts 80 . . .

Here, there will be described a procedure for assembling the rotary compression mechanism section 18 constituted of the first and second rotary compression elements 32, 34. First, the upper cover (not shown), the upper support member 156, and the upper cylinder 140 are positioned, and two upper bolts (not shown) to engage with the upper cylinder 140 are inserted from an upper cover side (upper side) in an axial center direction (downward direction) to integrate the upper cover, the upper support member, and the upper cylinder. Accordingly, the first rotary compression element 32 is assembled.

Next, after inserting the intermediate partition plate 36 from an upper end (first eccentric portion 144 side) of the rotation shaft 16, the first rotary compression element 32 integrated with the above-described upper bolts is inserted along the rotation shaft 16.

Moreover, after inserting the lower cylinder 138 from the lower end along the rotation shaft 16, and positioning the intermediate partition plate 36, the lower cylinder is positioned together with the already attached upper cylinder 140. Two bolts (not shown) to engage with the lower cylinder 138 are inserted from the upper cover side (upper side) in the axial center direction (upward direction), and the cylinders are fixed.

Furthermore, after inserting the lower support member 154 from the lower end along the rotation shaft 16, similarly the lower cover 68 is inserted from the lower end along the rotation shaft 16 to close the depressed portion formed in the lower support member 154. Four main bolts 80 . . . are inserted from the lower cover 68 side (lower side) in the axial center direction (upward direction). At this time, the thread ridges formed on the tip portions of the main bolts 80 . . . are engaged with the thread grooves formed in the upper cylinder 140 to fasten them, and the first and second rotary compression elements 32, 34 are assembled.

It is to be noted that the rotation shaft 16 is provided with the first eccentric portion 144 and the second eccentric portion 142. In a case where the diameter of the first eccentric portion 144 is set to be smaller than that of the second eccentric portion 142 as in the present embodiment, the first rotary compression element 32 cannot be attached to the rotation shaft 16 as described above unless the first rotary compression element is disposed above the intermediate partition plate 36.

On the other hand, the discharge noise absorbing chamber 162 communicates with the inside of the sealed container 12 via a communication path (not shown), and a high-temperature high-pressure refrigerant gas compressed by the second rotary compression element 34 is delivered into the sealed container 12.

Next, there will be described an operation of the rotary compressor of the present embodiment constituted as described above. When the electromotive element (stator coil) is energized via the terminal and the wiring line (not shown), the electromotive element is started to rotate the rotor. This rotation results in eccentric rotation of the first and second rollers 148, 146 fitted into the eccentric portions 142, 144 disposed integrally with the rotation shaft 16 in the upper and lower cylinders 138, 140.

Accordingly, a low-pressure refrigerant gas is sucked from the suction port 161 into the upper cylinder 140 on the low-pressure chamber side via a refrigerant introducing tube and a suction passage (not shown), and the gas is compressed by the operations of the first roller 148 and a vane 52 to obtain an intermediate pressure. The gas is discharged from the upper cylinder 140 on the high-pressure chamber side into the discharge noise absorbing chamber 164 via a discharge port 41.

The intermediate-pressure refrigerant gas discharged into the discharge noise absorbing chamber 164 passes through the refrigerant introducing tube (not shown) which communicates with the discharge noise absorbing chamber 164, and the gas is sucked from the suction port 160 to the lower cylinder 138 on the low-pressure chamber side via the suction passage formed in the lower support member 154.

The intermediate-pressure refrigerant gas sucked into the lower cylinder 138 is compressed in the second stage by the operations of the second roller 146 and a vane 50 to form a high-temperature high-pressure refrigerant gas. The gas is discharged from the lower cylinder 138 on the high-pressure chamber side into the discharge noise absorbing chamber 162 via a discharge port 39.

Moreover, the refrigerant discharged to the discharge noise absorbing chamber 162 is delivered into the sealed container 12 via the communication path (not shown). Thereafter, the refrigerant passes through the gap of the electromotive element to move into the upper part of the sealed container, and is discharged to the outside of the rotary compressor from the refrigerant discharge tube connected to the upper part of the sealed container.

As described above, as in the present embodiment, the heights of the upper and lower cylinders 140 and 138 constituting the first and second rotary compression elements 32, 34, respectively, are set to be equal. The inner diameters thereof are set to be equal. The diameter of the first eccentric portion 144 is set to be smaller than that of the second eccentric portion 142. Accordingly, sudden rise of a production cost due to a design change is suppressed. Moreover, the thickness of the first roller 148 is set to be larger than that of the second roller 146, so that the displacement volume of the first rotary compression element 32 can be set to be larger than that of the second rotary compression element 34. In consequence, the sealability of the first roller 148 is improved, and the volume efficiency of the first rotary compression element 32 can be improved.

It is to be noted that it has been described in the above embodiments that the rotation shaft is of a vertically disposed type, but, needless to say, the present invention is also applicable to a rotary compressor whose rotation shaft is of a horizontally disposed type.

Furthermore, it has been described that carbon dioxide is used as the refrigerant of the rotary compressor, but the present invention is also effective even in a case where another refrigerant is used.

What is claimed is:

1. The rotary compressor provided with a sealed container containing:

a driving element; and first and second rotary compression elements driven by a rotation shaft of the driving element, the displacement volume of the second rotary compression element being smaller than that of the first rotary compression element, and a refrigerant compressed by the first rotary compression element being compressed by the second rotary compression element to discharge the refrigerant into the sealed container, the rotary compressor comprising:

first and second cylinders constituting the first and second rotary compression elements, respectively;

first and second rollers fitted into first and second eccentric portions formed on the rotation shaft to eccentrically rotate in the first and second cylinders, respectively; and an intermediate partition plate which is disposed between the respective cylinders to close an opening of one of the opposite cylinders, a thickness of the first roller being set to be larger than that of the second roller, wherein heights of the opposite cylinders are set to be equal, diameters of the opposite eccentric portions are set to be equal, an inner diameter of the first cylinder is set to be larger than that of the second cylinder, and the thickness of the first roller is set to be larger than that of the second roller.

2. The rotary compressor provided with a sealed container containing:

a driving element; and first and second rotary compression elements driven by a rotation shaft of the driving element, the displacement volume of the second rotary compression element being smaller than that of the first rotary compression element, and a refrigerant compressed by the first rotary compression element being compressed by the second rotary compression element to discharge the refrigerant into the sealed container, the rotary compressor comprising:

first and second cylinders constituting the first and second rotary compression elements, respectively;

first and second rollers fitted into first and second eccentric portions formed on the rotation shaft to eccentrically rotate in the first and second cylinders, respectively; and an intermediate partition plate which is disposed between the respective cylinders to close an opening of one of the opposite cylinders, a thickness of the first roller being set to be larger than that of the second roller, wherein the first rotary compression element is disposed on a driving element side of the intermediate partition plate, the inner diameters of the opposite cylinders are set to be equal, the diameter of the first eccentric portion is set to be smaller than that of the second eccentric portion, and the thickness of the first roller is set to be larger than that of the second roller.

* * * * *